US011553787B1

(12) United States Patent
Glas

(10) Patent No.: US 11,553,787 B1
(45) Date of Patent: Jan. 17, 2023

(54) SPACE-SAVING FURNITURE ASSEMBLIES

(71) Applicant: Robert M. Glas, New Lenox, IL (US)

(72) Inventor: Robert M. Glas, New Lenox, IL (US)

(73) Assignee: Robert M. Glas, New Lenox, IL (US)

( * ) Notice: Subject to any disclaimer, the term of this patent is extended or adjusted under 35 U.S.C. 154(b) by 0 days.

(21) Appl. No.: 17/396,246

(22) Filed: Aug. 6, 2021

(51) Int. Cl.

| | |
|---|---|
| ***A47B 3/02*** | (2006.01) |
| ***A47G 23/06*** | (2006.01) |
| ***A47B 3/06*** | (2006.01) |
| ***A47B 3/12*** | (2006.01) |

(52) U.S. Cl.
CPC ..... *A47B 3/02* (2013.01); *A47B 3/06* (2013.01); *A47B 3/12* (2013.01); *A47G 23/06* (2013.01); *A47B 2003/025* (2013.01)

(58) Field of Classification Search
CPC .... A47B 3/02; A47B 3/06; A47B 3/12; A47B 2003/025; A47B 83/045; A47G 23/06
USPC ..... 108/11–19, 115–120, 90; 312/277
See application file for complete search history.

(56) References Cited

U.S. PATENT DOCUMENTS 348,201 A * 8/1886 Goodnow ..... D06F 81/04 108/121
479,301 A * 7/1892 Parmelee ..... D06F 81/04 108/121
517,756 A * 4/1894 Maurer
606,845 A * 7/1898 Simmons ..... A47B 3/02 108/120
748,956 A * 1/1904 Johnson ..... A47B 3/02 248/439
1,206,582 A * 11/1916 Orofino ..... A47B 3/087 108/130
1,280,619 A * 10/1918 Leick ..... A47B 97/04 312/282
1,559,426 A * 10/1925 Hekrdle ..... A47B 3/02 108/120
1,834,792 A * 12/1931 Mastrangelo ..... A47B 83/045 248/240.4
1,933,144 A * 10/1933 Karp ..... A47B 83/045 312/289
3,141,425 A * 7/1964 Duer ..... A47B 3/02 108/120
3,270,693 A * 9/1966 Lind ..... A47B 3/00 108/133
3,565,019 A * 2/1971 Bedol ..... A47B 3/02 108/120

(Continued)

*Primary Examiner* — Janet M Wilkens
*Assistant Examiner* — Timothy M Ayres
(74) *Attorney, Agent, or Firm* — Nixon Peabody LLP

(57) ABSTRACT

A furniture assembly includes a housing unit, a table top, and one or more folding tables. Each folding table includes a base and an x-shaped leg assembly coupled to the base. The base includes two support beams disposed along a first pair of opposite ends of a perimeter of a bottom surface thereof, and one or more support bars coupled between the two support beams. The x-shaped leg assembly includes a first rectangular frame having a first leg and a second leg connected by a first cross beam proximal to the bottom surface of the base, and a second rectangular frame mechanically coupled to the first rectangular frame and the base. The first cross beam has one or more channels for accommodating each of the one or more support bars and moves along them between the two support beams to fold and unfold the folding table.

16 Claims, 14 Drawing Sheets

(56) References Cited

U.S. PATENT DOCUMENTS

| | | | | | |
|---|---|---|---|---|---|
| 3,897,738 | A * | 8/1975 | Minsky | A47B 3/02 | 108/119 |
| 4,117,781 | A * | 10/1978 | Middleton | A47B 23/00 | 108/19 |
| 5,337,682 | A * | 8/1994 | Wiseman | A47B 23/04 | 108/118 |
| 9,609,943 | B1 * | 4/2017 | Lin | A47C 4/14 | |
| 2004/0040480 | A1 * | 3/2004 | Hwang | A47B 3/02 | 108/145 |
| 2018/0255918 | A1 * | 9/2018 | Walker | A47B 3/002 | |

* cited by examiner

SPACE-SAVING FURNITURE ASSEMBLIES

FIELD OF THE INVENTION

The present invention relates generally to furniture assemblies, and more specifically, to space-saving furniture assemblies.

BACKGROUND OF THE INVENTION

Every home is filled with furniture, whether it be tables and chairs or couches and side tables. However, people who live in smaller houses or apartments do not have the luxury of furnishing their homes with a wide range of furniture because of the limited floor space available to them. Accordingly, it is desirable to have a space-saving furniture assembly that would allow people to have furniture that meets all of their needs while not taking up their precious home floor space.

Similarly, people find home furniture difficult and time-consuming to assemble or disassemble. Various furniture assembly instructions require the use of tools and hardware for both assembly and disassembly, and could takes hours to perform. Even when assembly is complete, furniture can be a hassle to move and takes a lot of time to disassemble. Accordingly, it is desirable to have furniture that requires little time and energy to assemble, and similarly, to disassemble.

SUMMARY OF THE INVENTION

The term embodiment and like terms, e.g., implementation, configuration, aspect, example, and option, are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter. This summary is also not intended to be used in isolation to determine the scope of the claimed subject matter. The subject matter should be understood by reference to appropriate portions of the entire specification of this disclosure, any or all drawings, and each claim.

According to some implementations of the present disclosure, a folding table is disclosed. The folding table comprises a base and an x-shaped leg assembly coupled to the base. The base includes two support beams disposed along a first pair of opposite ends of a perimeter of a bottom surface of the base, and one or more support bars coupled between the two support beams. The x-shaped leg assembly includes a first rectangular frame and a second rectangular frame. The first rectangular frame includes a first leg and a second leg connected by a first cross beam proximal to the bottom surface of the base. The first cross beam has one or more channels for accommodating each of the one or more support bars. The second rectangular frame is mechanically coupled to the first rectangular frame and the base. The first cross beam moves along the one or more support bars between the two support beams to fold and unfold the folding table.

According to some implementations of the present disclosure, a space-saving furniture assembly is disclosed. The space-saving furniture assembly includes a housing unit, a table top, and one or more folding tables. The table top and the one or more folding tables are stored within the housing unit. Each folding table includes a base and an x-shaped leg assembly coupled to the base. The base includes two support beams disposed along a first pair of opposite ends of a perimeter of a bottom surface of the base, and one or more support bars coupled between the two support beams. The x-shaped leg assembly includes a first rectangular frame and a second rectangular frame. The first rectangular frame includes a first leg and a second leg connected by a first cross beam proximal to the bottom surface of the base. The first cross beam has one or more channels for accommodating each of the one or more support bars. The second rectangular frame is mechanically coupled to the first rectangular frame and the base. The first cross beam moves along the one or more support bars between the two support beams to fold and unfold the folding table.

The above summary is not intended to represent each embodiment or every aspect of the present disclosure. Rather, the foregoing summary merely provides an example of some of the novel aspects and features set forth herein. The above features and advantages, and other features and advantages of the present disclosure, will be readily apparent from the following detailed description of representative embodiments and modes for carrying out the present invention, when taken in connection with the accompanying drawings and the appended claims. Additional aspects of the disclosure will be apparent to those of ordinary skill in the art in view of the detailed description of various embodiments, which is made with reference to the drawings, a brief description of which is provided below.

BRIEF DESCRIPTION OF THE DRAWINGS

The disclosure, and its advantages and drawings, will be better understood from the following description of representative embodiments together with reference to the accompanying drawings. These drawings depict only representative embodiments, and are therefore not to be considered as limitations on the scope of the various embodiments or claims.

Figure 1A:
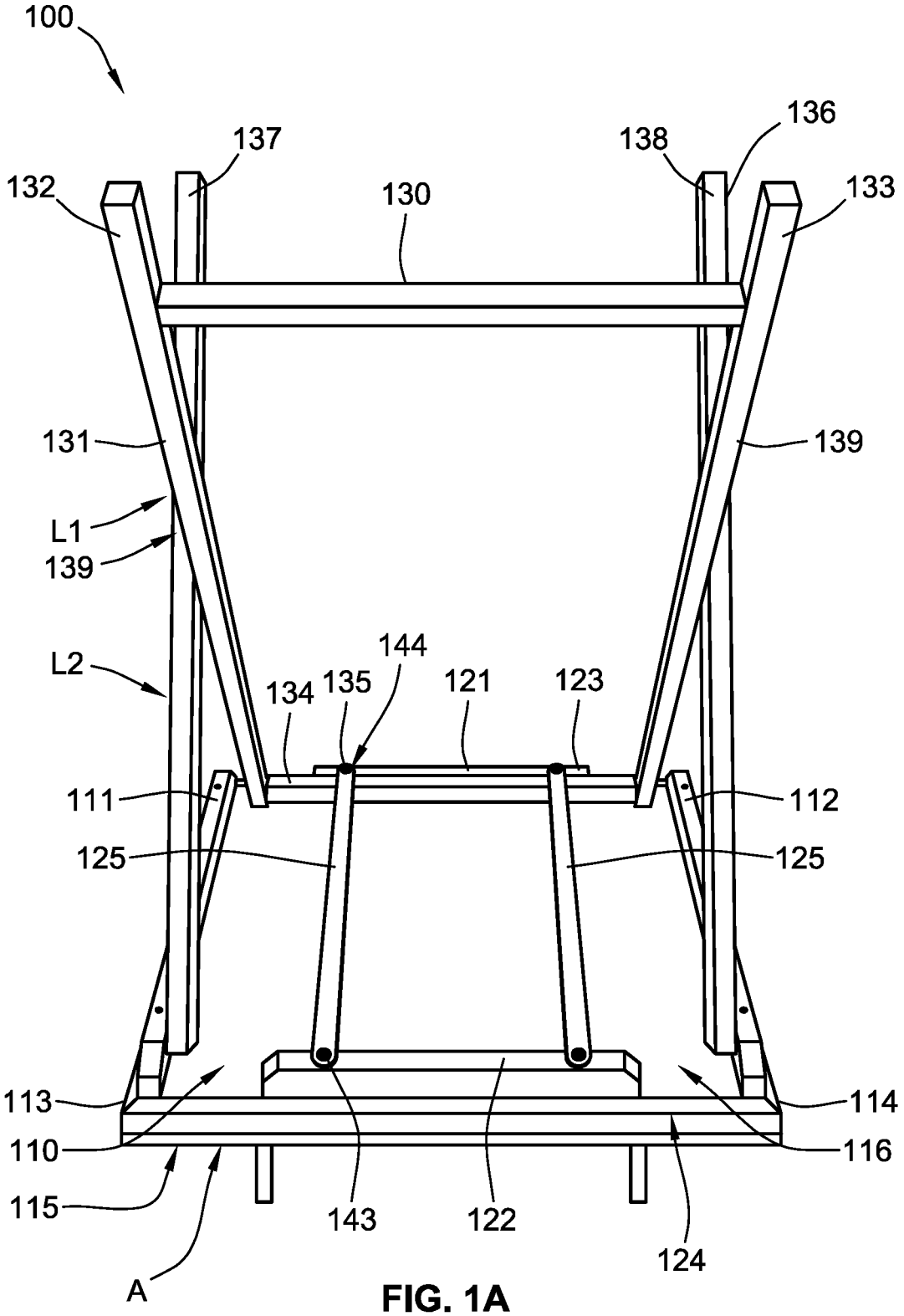
FIG. 1A is a bottom perspective view of a folding table placed in the space-saving furniture assembly according to certain aspects of the present disclosure.

The present disclosure is susceptible to various modifications and alternative forms, and some representative embodiments have been shown by way of example in the drawings and will be described in detail herein. It should be understood, however, that the invention is not intended to be limited to the particular forms disclosed. Rather, the disclosure is to cover all modifications, equivalents, and alternatives falling within the spirit and scope of the invention as defined by the appended claims.

DETAILED DESCRIPTION

Embodiments of the disclosure are directed to a space-saving furniture assembly, which enables the benefit of having one or more folding tables, a reversible serving tray, and a table top stored within one housing unit. The space-saving furniture assembly enables having a variety of common furniture uses without sacrificing limited available floor space. The space-saving furniture assembly includes components that enable the formation of furniture such as, but not limited to, one or more folding tables, a reversible serving tray, a folding table with a reversible serving tray placed on the folding table, a dining table that seats six people, and a coffee table. The space-saving furniture assembly provides all of these various implementations without occupying significant floor space since all the components can be compactly stored within a housing unit, when not in use.

Various embodiments are described with reference to the attached figures, where like reference numerals are used throughout the figures to designate similar or equivalent elements. The figures are not necessarily drawn to scale and are provided merely to illustrate aspects and features of the present disclosure. Numerous specific details, relationships, and methods are set forth to provide a full understanding of certain aspects and features of the present disclosure, although one having ordinary skill in the relevant art will recognize that these aspects and features can be practiced without one or more of the specific details, with other relationships, or with other methods. In some instances, well-known structures or operations are not shown in detail for illustrative purposes. The various embodiments disclosed herein are not necessarily limited by the illustrated ordering of acts or events, as some acts may occur in different orders and/or concurrently with other acts or events. Furthermore, not all illustrated acts or events are necessarily required to implement certain aspects and features of the present disclosure.

For purposes of the present detailed description, unless specifically disclaimed, and where appropriate, the singular includes the plural and vice versa. The word "including" means "including without limitation." Moreover, words of approximation, such as "about," "almost," "substantially," "approximately," and the like, can be used herein to mean "at," "near," "nearly at," "within 3-5% of," "within acceptable manufacturing tolerances of," or any logical combination thereof. Similarly, terms "vertical" or "horizontal" are intended to additionally include "within 3-5% of" a vertical or horizontal orientation, respectively. Additionally, words of direction, such as "top," "bottom," "left," "right," "above," and "below" are intended to relate to the equivalent direction as depicted in a reference illustration; as understood contextually from the object(s) or element(s) being referenced, such as from a commonly used position for the object(s) or element(s); or as otherwise described herein.

Referring to the figures, FIG. 1A shows a bottom perspective view of a folding table 100 that is disposed in a space-saving furniture assembly 300 (shown in FIG. 3). The folding table 100 includes a base 110 and a x-shaped leg assembly 130. The base 110 includes a top surface 115 and a bottom surface 116. The top surface 115 has a polygonal shape (e.g. a triangle, pentagon, hexagon, etc.) and interacts with various components of the space-saving furniture assembly 300 (shown in FIG. 3). The bottom surface 116 has a polygonal shape (e.g., a triangle, pentagon, hexagon, etc.) with a perimeter A. In the embodiment shown in FIG. 1A, the bottom surface 116 is shaped as a rectangle with a first pair of opposing ends 123, 124 and a second pair of opposing ends 113, 114. A first support beam 121 and a second support beam 122 are disposed along the first pair of opposing ends 123, 124, respectively of the perimeter A of the bottom surface 116. A first side beam 111 and a second side beam 112 are disposed along the second pair of opposing ends 113, 114, respectively of the perimeter A of the bottom surface 116.

One or more support bars 125 are coupled between the two support beams 121, 122. In the embodiment shown in FIG. 1A, the base 110 includes two support bars 125. However, in other embodiments, it is contemplated that there may be one support bar, three support bars, four support bars, etc. The support bars 125 are coupled to the first support beam 121 at a first coupling point 144 and the second support beam 122 at a second coupling point 143. In some embodiments, the support bars 125 are made from a sturdy and durable material such as, but not limited to, wood, stainless steel, aluminum, and the like. In some embodiments, the first side beam 111 and the second side beam 112 are parallel to each other, while the two support beams 121, 122 are perpendicular to both the first side beam 111 and the second side beam 112, as shown in FIG. 1A. Further, in some embodiments, the support bars 125 extend parallel to the first side beam 111 and the second side beam 112, as shown in FIG. 1A.

The x-shaped leg assembly 130 is coupled to the first side beam 111 and the second side beam 112. The x-shaped leg assembly 130 contains a first rectangular frame 131 having a first leg 132 and a second leg 133. The first leg 132 and second leg 133, each having a length L1, are connected by a first cross beam 134. The first cross beam 134 is located proximal to the bottom surface 116 of the base 110. The first cross beam 134 contains one or more channels 135 which accommodate each of the support bars 125. Thus, the number of channels 135 are equal to the number of support bars 125. When unfolding the folding table, the first cross beam 134 moves along the support bars 125 via the channels 135 from the first support beam 121 to the second support beam 122.

The x-shaped leg assembly 130 also includes a second rectangular frame 136 having a third leg 137 and a fourth leg 138. The third leg 137 and the fourth leg 138, each having a length L2, are coupled to the first side beam 111 and the second side beam 112, respectively. The second rectangular frame 136 is mechanically coupled to the first rectangular frame 131 at center points 139 along the length L1 of the first rectangular frame 131 and the length L2 of the second rectangular frame 136.

Figure 1B:
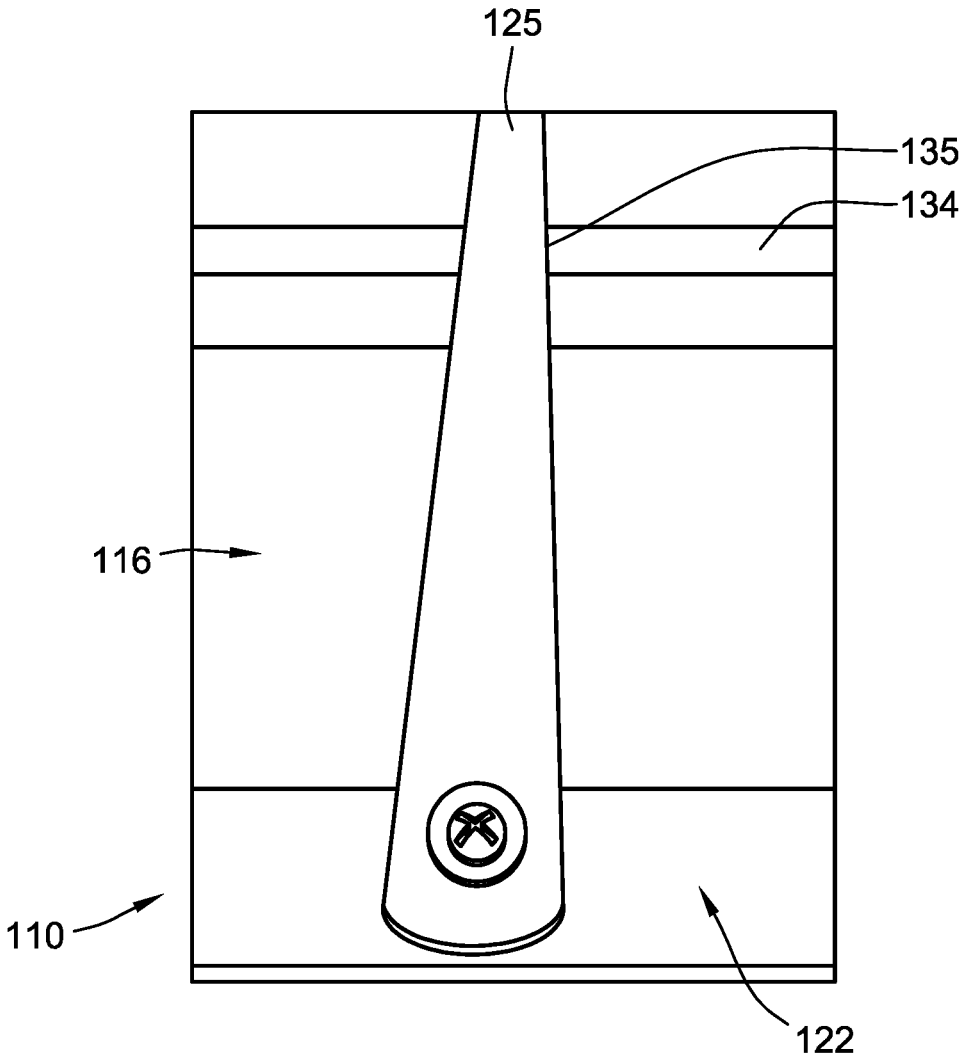
FIG. 1B is a close-up of the bottom perspective view of FIG. 1A showing a channel accommodating a support bar in an x-shaped leg assembly of the folding table, according to certain aspects of the present invention.
Figure 1C:
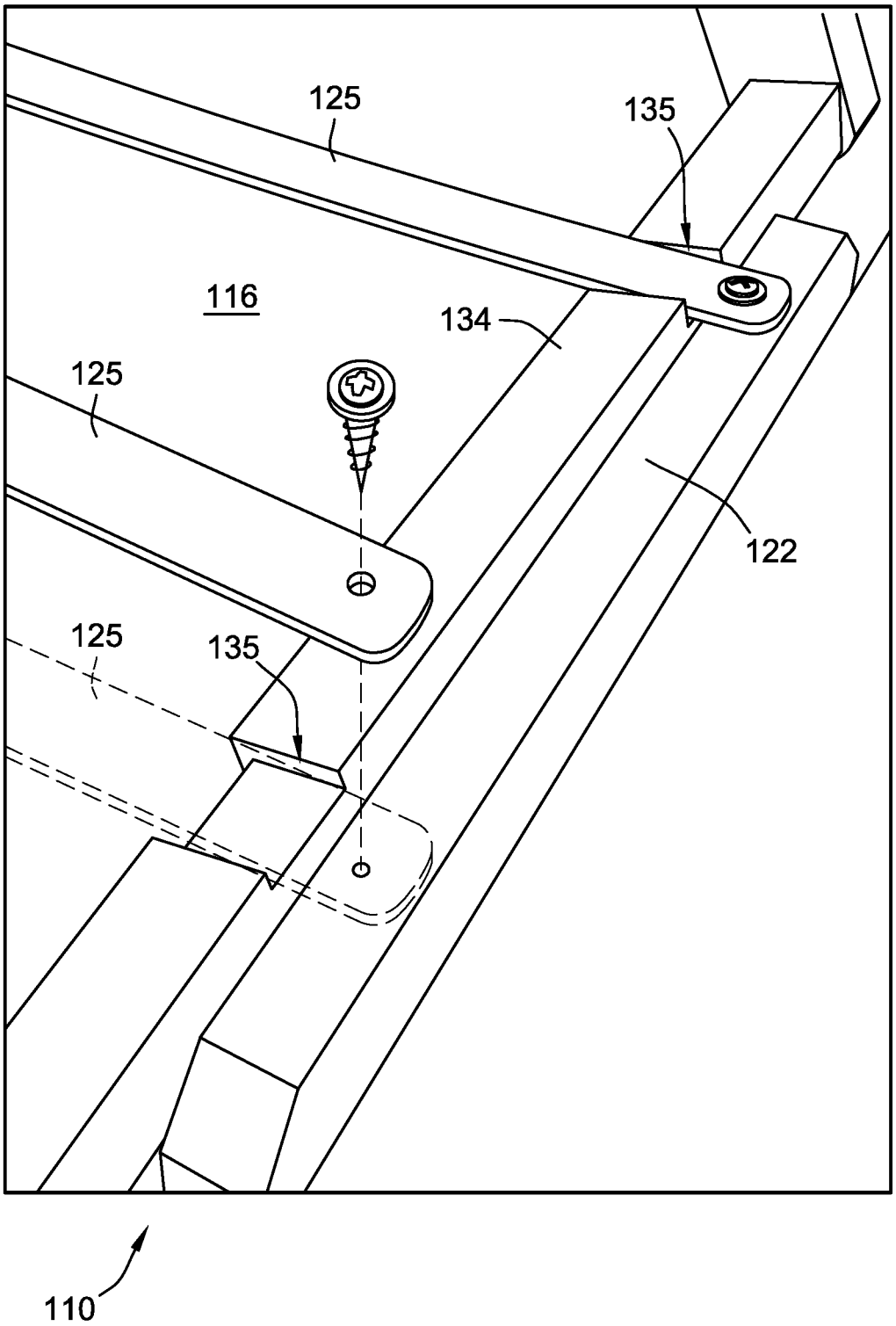
FIG. 1C is an exploded perspective view of the channel of FIG. 1B showing how the channel accommodates the support bar of the folding table, according to certain aspects of the present invention.

FIG. 1B shows an enhanced close-up of the bottom perspective view of FIG. 1A showing the channel 135 accommodating the support bar 125. FIG. 1C shows an exploded perspective view of the channel 135 showing how the channel 135 accommodates the support bar 125. The first cross beam 134, located adjacent to the bottom surface 116 of the base 110, contains the channel 135. The support bar 125 is coupled to the first support beam 121 and the second support beam 122 using fasteners (e.g., a screw as shown in FIG. 1C) such that a bottom surface (not shown) of the support bar 125 rests on the channel 135 of the first cross beam 134. To actuate unfolding of the folding table, the first cross beam 134 moves along the support bar 125, from the first support beam 121 to the second support beam 122. The channel 135 aids in guiding the first cross beam 134 along the bottom surface of the support bar 125.

Figure 2A:
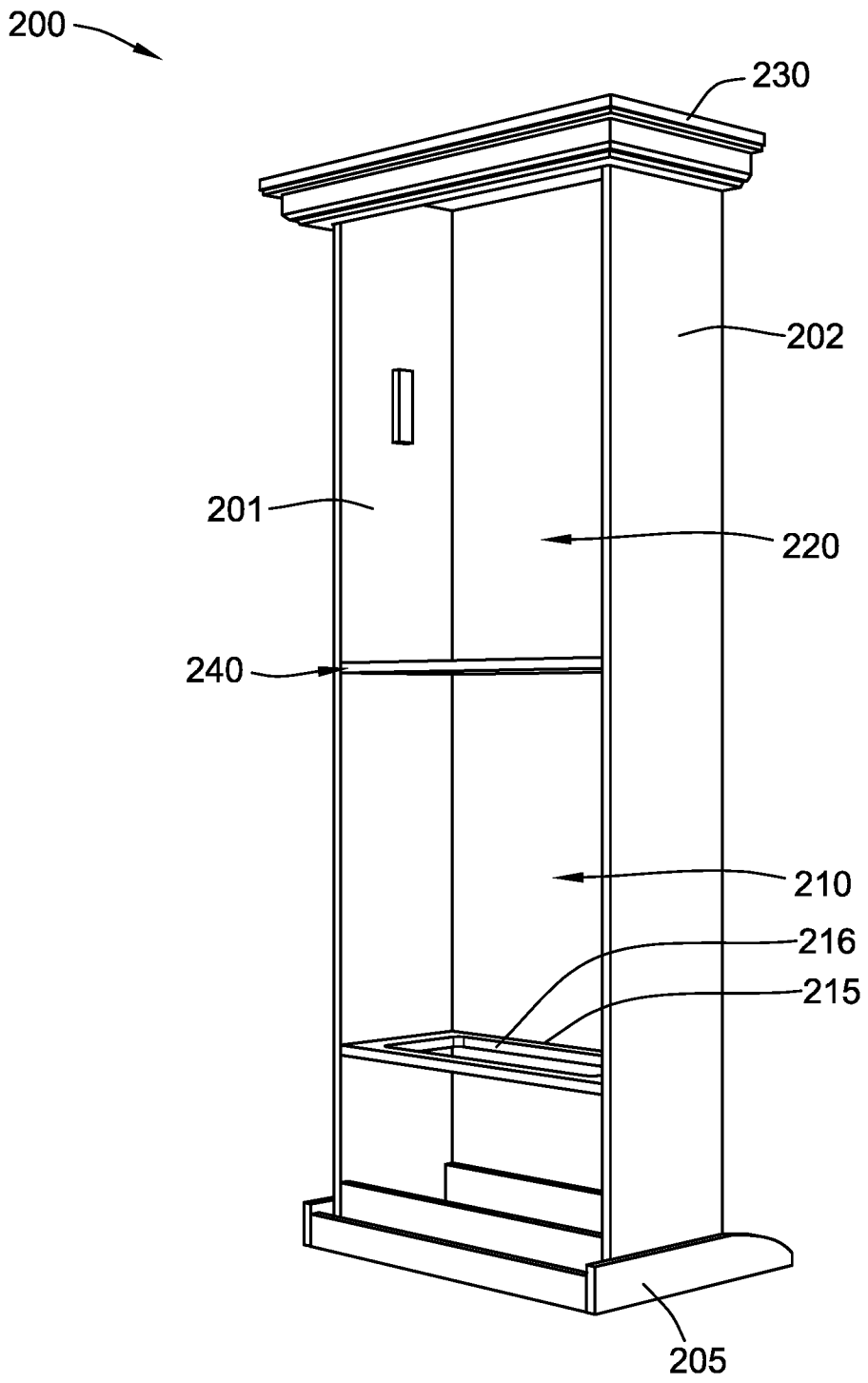
FIG. 2A is a front perspective view of the housing unit in the space-saving furniture assembly, according to certain aspects of the present invention.
Figure 2B:
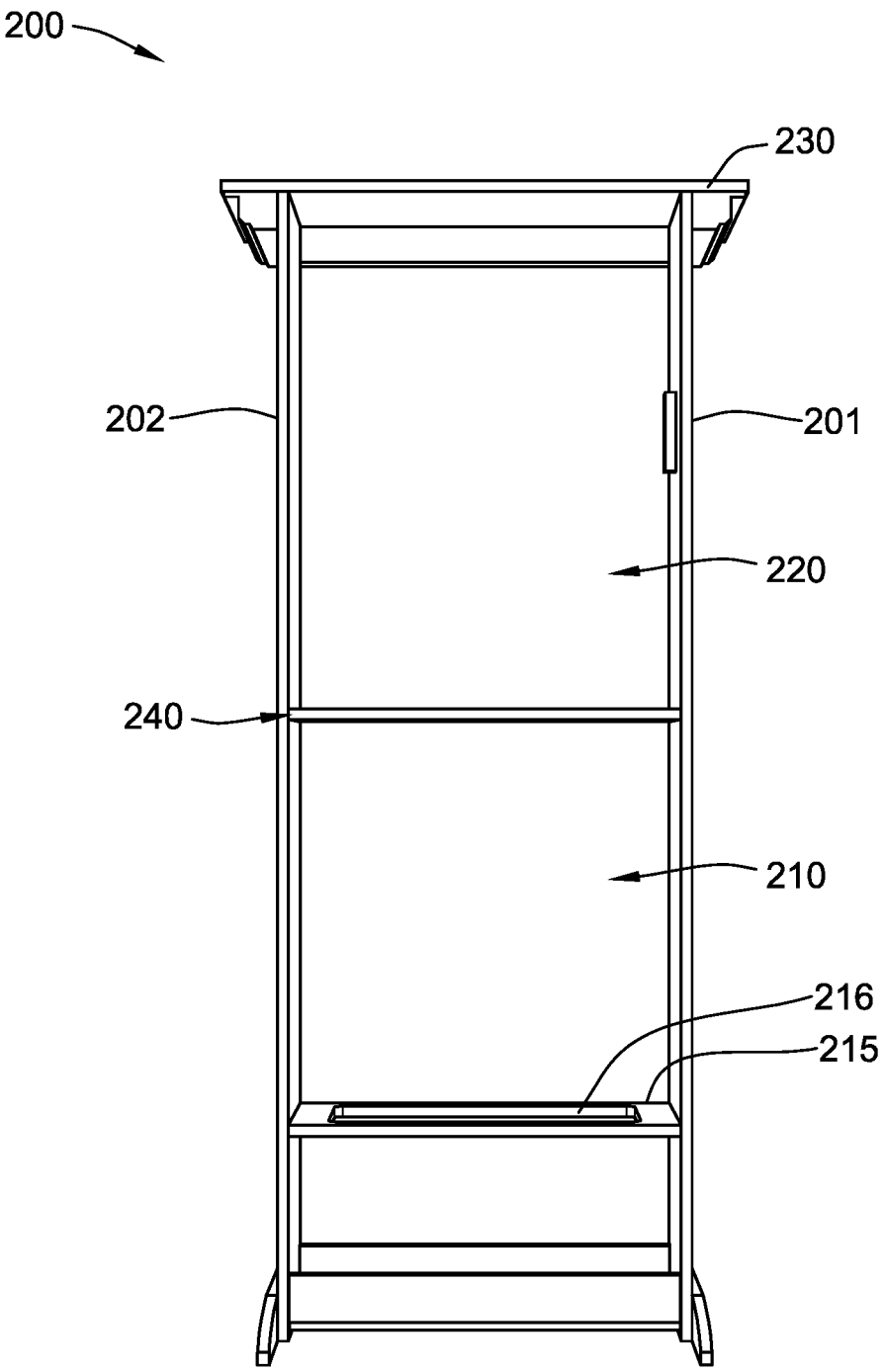
FIG. 2B is a rear perspective view of the housing unit of FIG. 2A, according to certain aspects of the present invention.
Figure 2C:
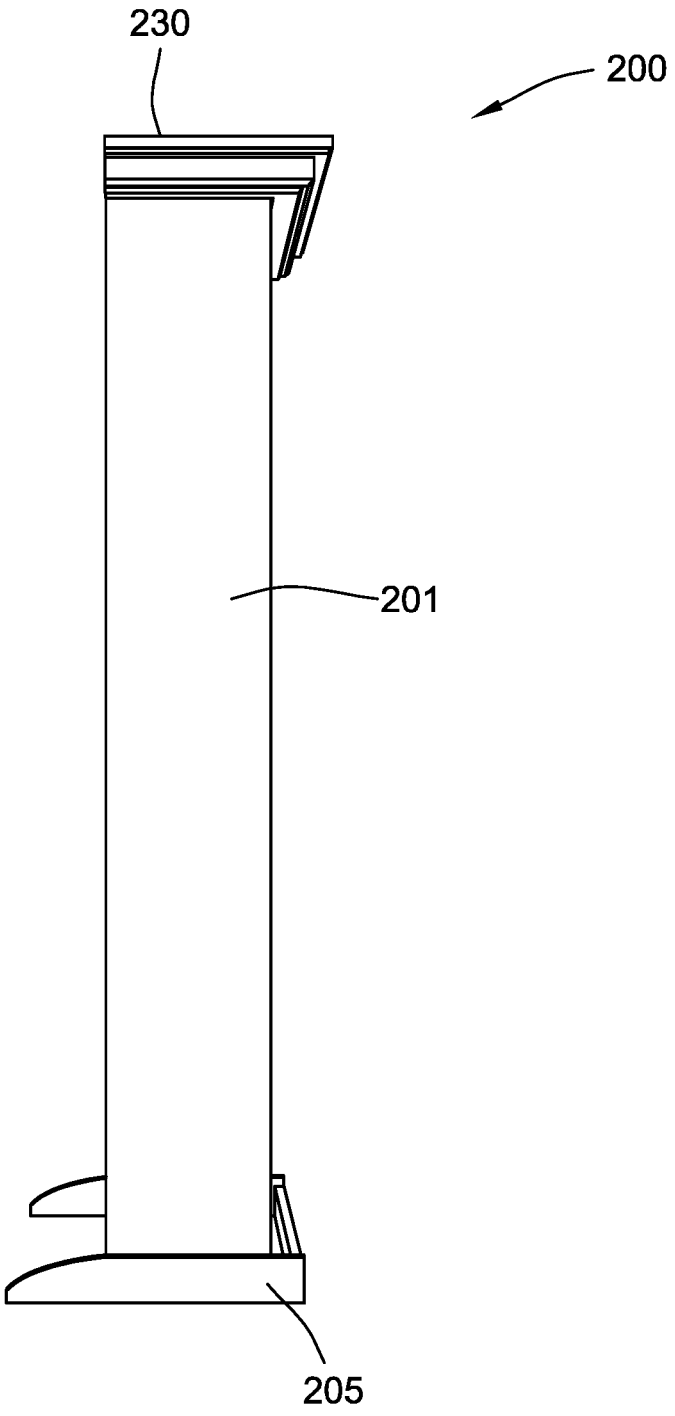
FIG. 2C is a side view of the housing unit of FIG. 2A, according to certain aspects of the present invention.

FIGS. 2A-2B show front and rear perspective views of a housing unit 200 for storing the space-saving furniture assembly, while FIG. 2C shows a side view of the housing unit 200. The housing unit 200 contains a first sidewall 201 and a second sidewall 202, a standing base 205, and a top panel 230. The housing unit 200 is separated into a first chamber 210 and a second chamber 220. The first chamber 210 is separated from the second chamber 220 by a separating panel 240. Both the first chamber 210 and the second chamber 220 are used to store different components of the space-saving furniture assembly. The first chamber 210 contains a divider 215 having a slot 216, which are used to store one or more folding tables 100 (FIG. 1A).

In some embodiments, the housing unit 200 can be mounted on a wall by drilling the housing unit 200 therein. This provides the benefit of allowing the end-user additional storage space underneath the mounted housing unit 200. The housing unit 200 can be made from a sturdy, durable, and aesthetically-pleasing material such as, but not limited to, wood, stainless steel, plastic. The housing unit 200 when standing or when wall-mounted can function as an aesthetically-pleasing decorative piece of furniture.

Figure 3A:
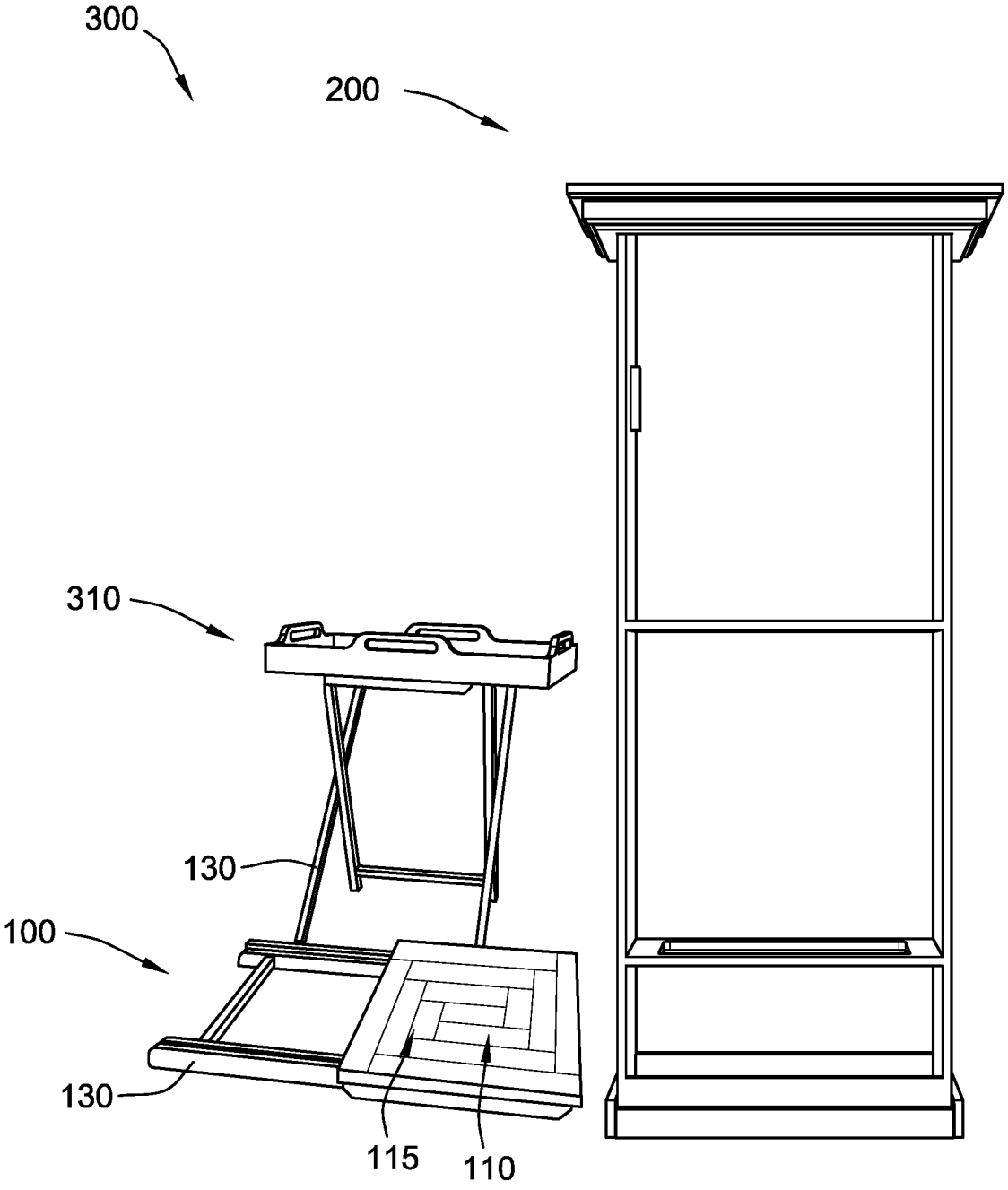
FIG. 3A is a perspective view of the components of in the space-saving furniture assembly, according to certain aspects of the present invention.

FIG. 3A shows a perspective view of the components of the space-saving furniture assembly 300 in disassembled form. The space-saving furniture assembly 300 contains a housing unit 200, a reversible serving tray 310, and one or more folding tables 100. As described with respect to FIGS. 1A-1B, each of the folding tables 100 contains an x-shaped leg assembly 130, and a base 110 having a top surface 115. The housing unit 200 is designed to store one or more folding tables 100, the reversible serving tray 310, as well as other furniture components of the space-saving furniture assembly.

Figure 3B:
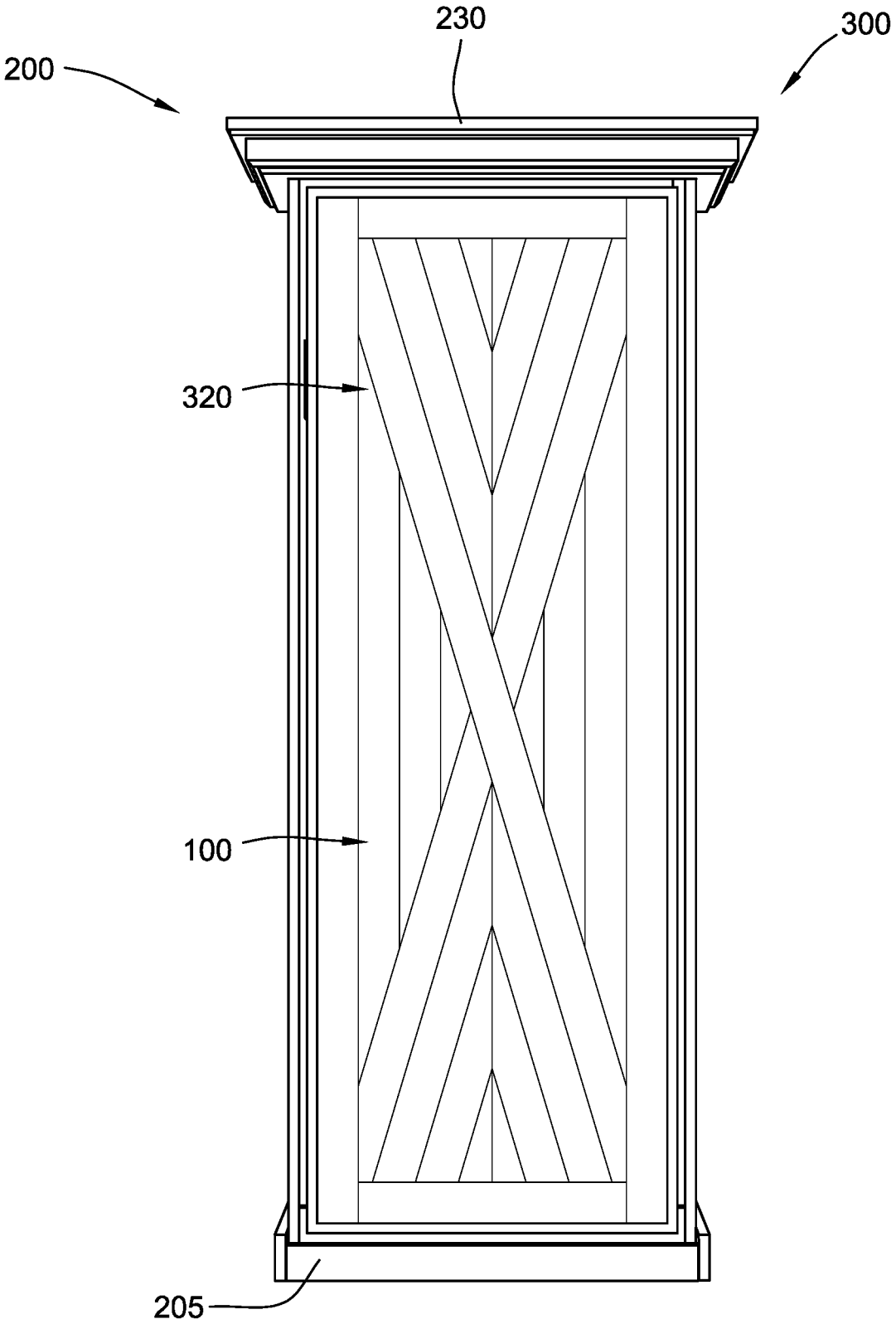
FIG. 3B is a front perspective view of the space-saving furniture assembly when all the components are stored within the housing unit, according to certain aspects of the present invention.
Figure 3C:
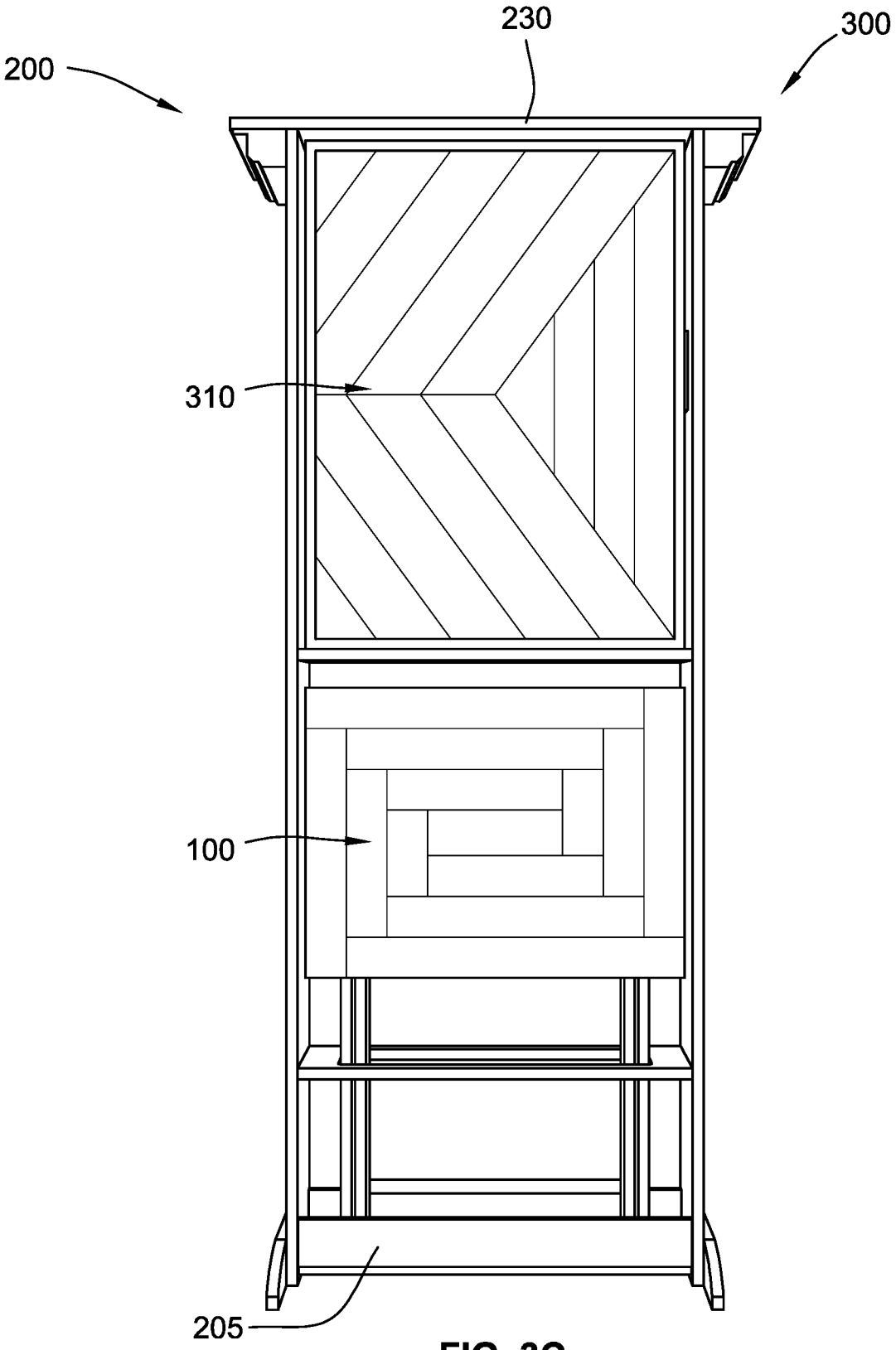
FIG. 3C is a rear perspective view of the space-saving furniture assembly when all the components are stored within the housing unit, according to certain aspects of the present invention.

FIGS. 3B-3C show front perspective and rear perspective views of the space-saving furniture assembly 300, when all the components are stored within the housing unit 200. FIG. 3B shows a front view of a table top 320 stowed in the housing unit 200 of the furniture assembly 300. The table top 320 is accommodated between the standing base 205 and the top panel 230 of the housing unit 200. The table top 320 forms a dining table, when placed over two folding tables 100 and forms a coffee table, when placed over detachable legs 610 described in detail below. The table top 320 functions as a cover of the space-saving furniture assembly 300 by preventing all of the components within the space-saving furniture assembly 300 from being seen, when stored within the housing unit 200, as shown in FIG. 3B. When all of the components of the space-saving furniture assembly 300 are stored within the housing unit 200, the table top 320 can be placed in a way in which the other components are not seen, such as the one or more folding tables 100. The table top 320 can be made from a sturdy, durable, and aesthetically-pleasing material such as, but not limited to, wood, stainless steel, plastic.

FIG. 3C shows a rear view of a reversible serving tray 310 and folding table 100 stowed in the housing unit 200 of the furniture assembly 300. The reversible serving tray 310, described in further detail below with respect to FIGS. 4A-4B, functions as both a serving tray and a countertop for the folding tables 100. The reversible serving tray 310 can be made from a sturdy, durable, and aesthetically pleasing material such as, but not limited to, wood, stainless steel, plastic. The housing unit 200 can be configured to store two, three, four, or five folding tables 100, as described with respect to FIGS. 1A-1B. When unfolded, the one or more folding tables 100 can be stored within the housing unit 200 as shown.

Figure 4A:
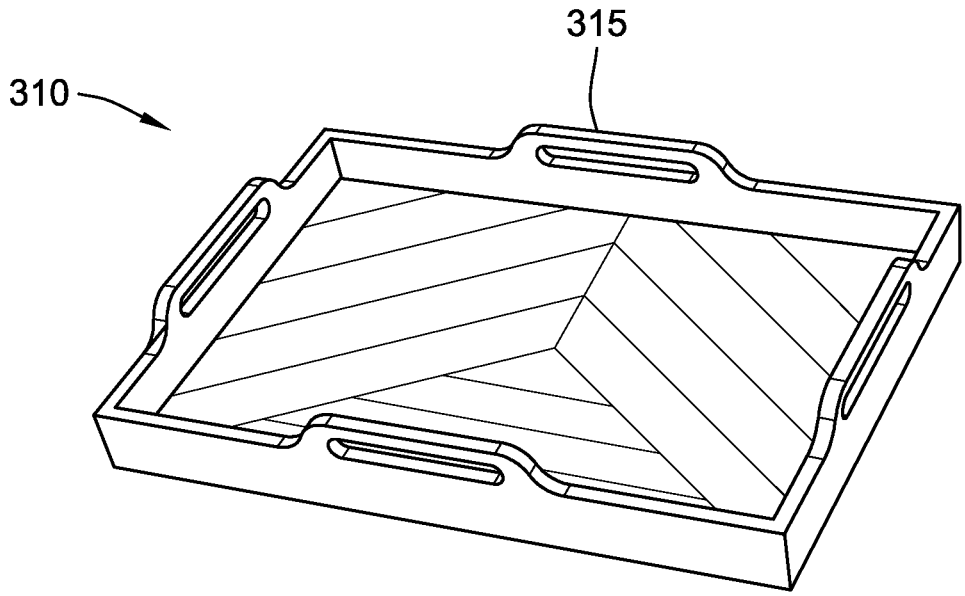
FIG. 4A is a perspective view of a reversible serving tray placed in the space-saving furniture assembly, according to certain aspects of the present invention.
Figure 4B:
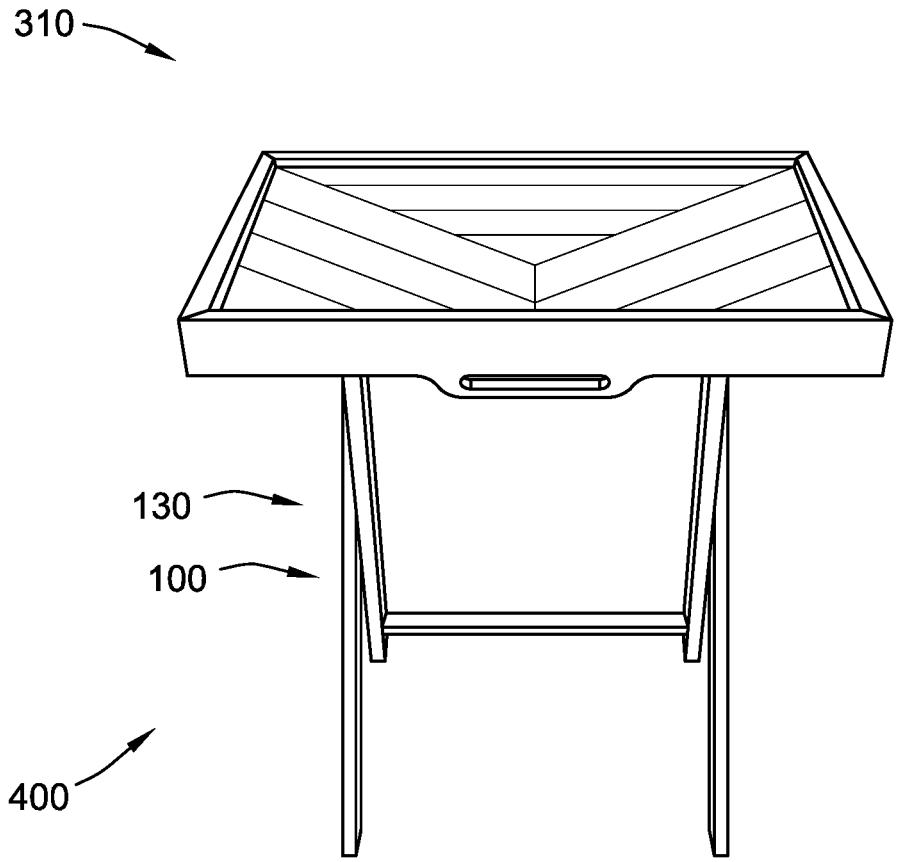
FIG. 4B is a perspective view of the reversible serving tray of FIG. 4A in combination with the folding table of FIGS. 1A-1B, according to certain aspects of the present invention.

FIGS. 4A-4B show perspective views of the reversible serving tray 310 and the side table 400 formed by using the reversible serving tray 310 over the folding table 100, respectively. The reversible serving tray 310 has one or more handles 315. In the embodiment shown in FIG. 4A, the reversible serving tray 310 includes four handles 315, which is preferred because four handles 315 allow the user variety in carrying the reversible serving tray 310. In some embodiments, the reversible serving tray 310 can have two, four, six, or eight handles 315. The reversible serving tray 310 functions as both a stand-alone serving tray and as a countertop for the folding table 100 with an x-shaped leg assembly 130, as described in FIGS. 1A-1B. Further, the reversible serving tray 310 can be used in two different orientations, one with the handles 315 facing up and one with the handles 315 facing down. In either orientation, the reversible serving tray 310 functions as a removable countertop for the side table 400 and provides a larger surface area for the side table 400. Since the reversible serving tray 310 is portable, the reversible serving tray 310 can be used to transport goods to and from the side table 400. In some embodiments, the reversible serving tray 310 is configured to have the same polygonal shape as the folding table 100. As a non-limiting example, if the folding table 100 having a base 110 has a circular shape, then the reversible serving tray 310 will have a circular shape.

Figure 5A:
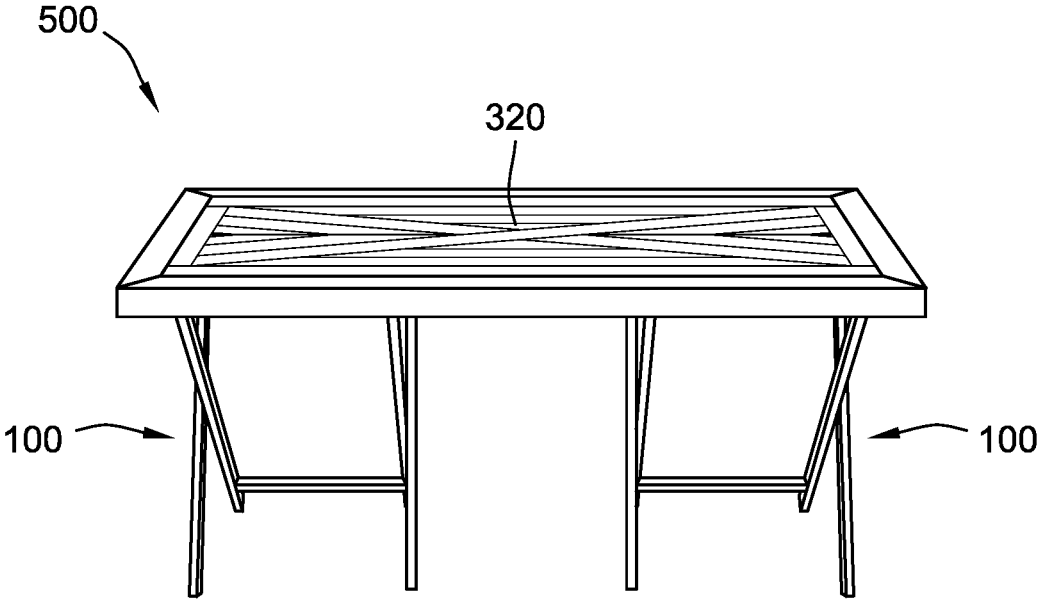
FIG. 5A is a perspective view of a table top assembled onto two of the folding tables of FIGS. 1A-1B, in one orientation to form a dining table, according to certain aspects of the present invention.
Figure 5B:
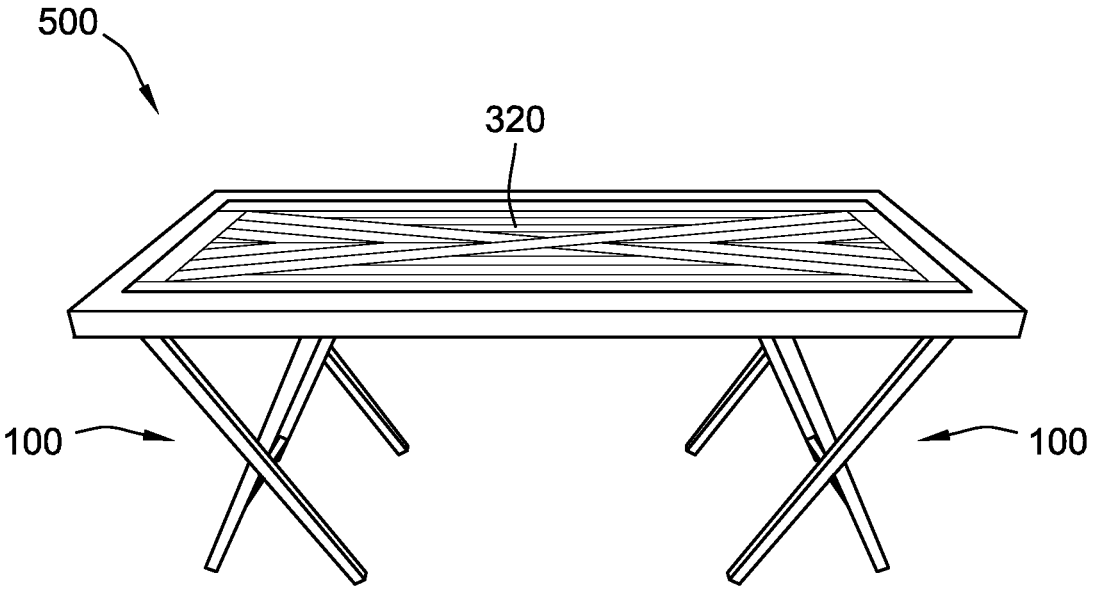
FIG. 5B is a perspective view of a table top assembled onto two of the folding tables of FIGS. 1A-1B in a different orientation to form a dining table, according to certain aspects of the present invention.

FIGS. 5A-5B show perspective views of a dining table 500. With respect to FIG. 5A, the dining table 500 is comprised of the table top 320 and two folding tables 100, with the folding tables 100 in the first orientation. The table top 320 is secured over the two folding tables 100 through means of a locking pin 520, as further described in relation to FIG. 5D. The dining table 500 is able to sit four or more people. In some embodiments, the dining table 500 can be assembled using more than two folding tables 100. This would allow for an increase in the number of seats available for the dining table 500 and would provide an improved sturdiness of the dining table 500.

The dining table 500 shown in FIG. 5B differs from the dining table 500 shown in FIG. 5A due to the orientation of the folding tables 100 when connected over the table top 320. The alternative orientation of the folding tables 100 allows for the end-user to position seats at the dining table 500 in various ways without sacrificing leg room. For example, the dining table 500 shown in FIG. 5A allows for optimal legroom when two people are sitting along each longer portion of table top 320. Conversely, the dining table 500 shown in FIG. 5B allows for optimal legroom when there is a person seated at each end of the table top 320.

Further, the dining table 500 shown in FIG. 5B can function as a serving table or a kitchen island. In some embodiments, the dining table 500 can be assembled using more than two folding tables 100. This is possible with the folding tables 100 positioned in either orientation described above. In the embodiments shown in FIGS. 5A-5B, the table top 320 is rectangular in shape. However, the table top 320, in some embodiments, can have a polygonal shape other than a rectangle. In those embodiments, the folding tables 100 can be positioned in either orientation as described above.

Figure 5C:
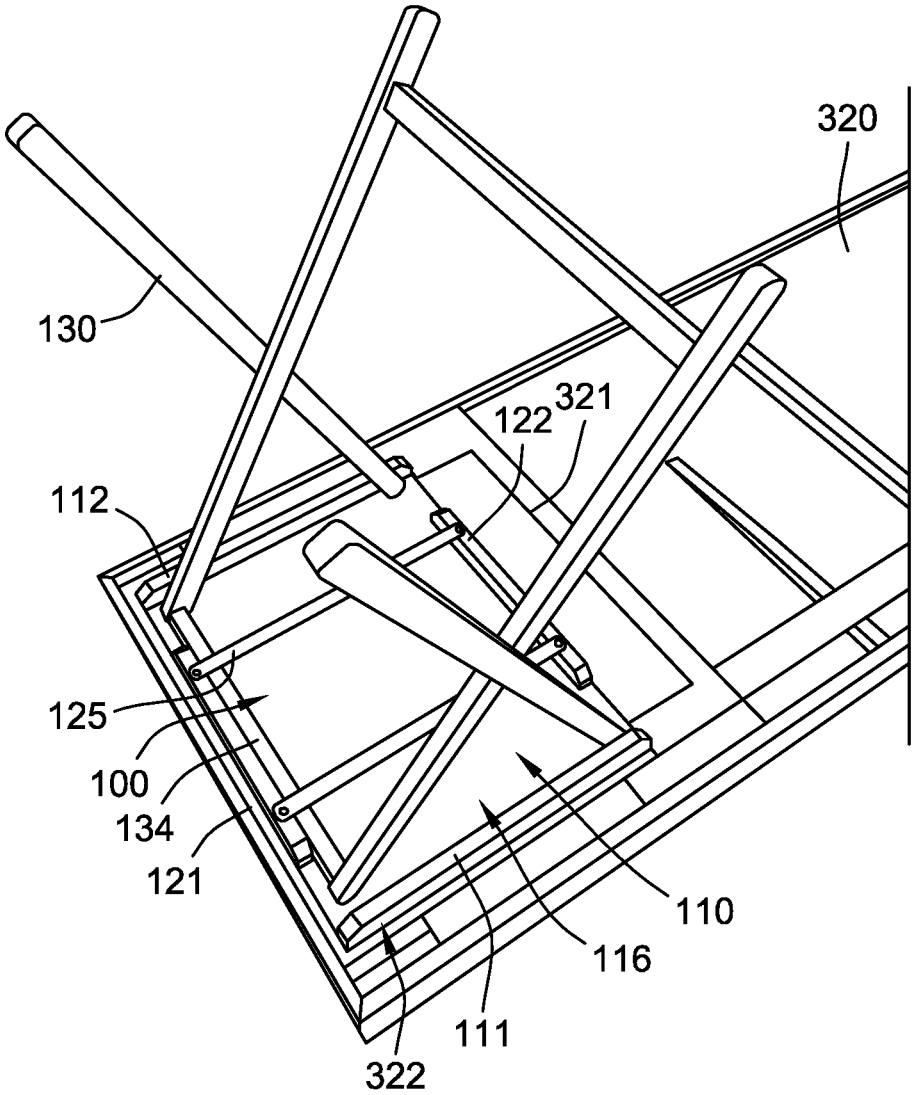
FIG. 5C is a perspective view showing how the table top is assembled onto the folding table of FIGS. 1A-1B, according to certain aspects of the present invention.

FIG. 5C shows a perspective view of how the table top 320 is secured to a folding table 100. The folding table 100, as described in FIG. 1A-1B, includes a base 110 and an x-shaped leg assembly 130. The base 110 has a bottom surface 116 that includes a first side beam 111 and a second side beam 112, two support beams 121, 122, and one or more channels 135. The x-shaped leg assembly 130 also includes the first cross beam 134. The table top 320 has two cutouts 321 and 322. Each cutout 321, 322, is used for accompanying the folding table 100 when it is secured to the table top 320 in either orientation, as shown in FIG. 5A-5B. Therefore, to assemble the dining table 500 of FIG. 5A, the folding table 100 will be placed on the cutout 321 and ultimately secured to the table top 320. Similarly, to assemble the dining table 500 of FIG. 5B, the folding table 100 will be placed on the cutout 322 and ultimately secured to the table top 320. In some embodiments, the folding table 100 can have a polygonal shape other than a rectangle. In that case, the cutouts 321, 322 of the table top 320 will have the same polygonal shape as the folding table 100. In the embodiment shown in FIGS. 5A-5B, the dining table 500 contains two folding tables 100, and therefore, the table top 320 will have two identical cutouts 321 and 322, where each cutout 321, 322 is located at opposing ends of the table top 320.

Figure 5D:
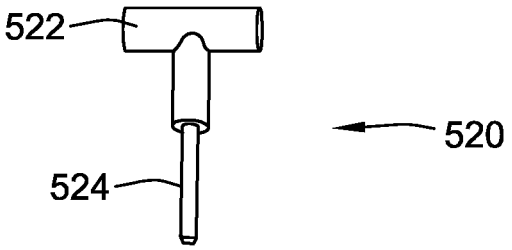
FIG. 5D is a perspective view of a locking pin used to secure the table top to the folding table of FIGS. 1A-1B, according to certain aspects of the present invention.

FIG. 5D shows a perspective view of a locking pin 520 used to secure the table top 320 (not shown) to the folding table 100 (not shown) to assemble the dining table 500, as shown in FIGS. 5A-5B. The locking pin 520 has a handle 522 and a locking component 524. The locking pin 520 is inserted into each end of the table top 320 when the table top 320 is placed over the folding table 100 at the cutout 321 to secure the table top 320 to the folding table 100. The handle 522 of the locking pin 520 is rotated to lock the table top 320 to the folding table 100. The handle 522 provides the benefit of having superior ease of use and allows for the locking pin 520 to be rotated. Alternatively, the table top 320 can be secured to the folding table 100 through a threaded element, such as a screw, or a hinge secured on the cutouts 321, 322 that couples to both the table top 320 and folding table 100.

Figure 6A:
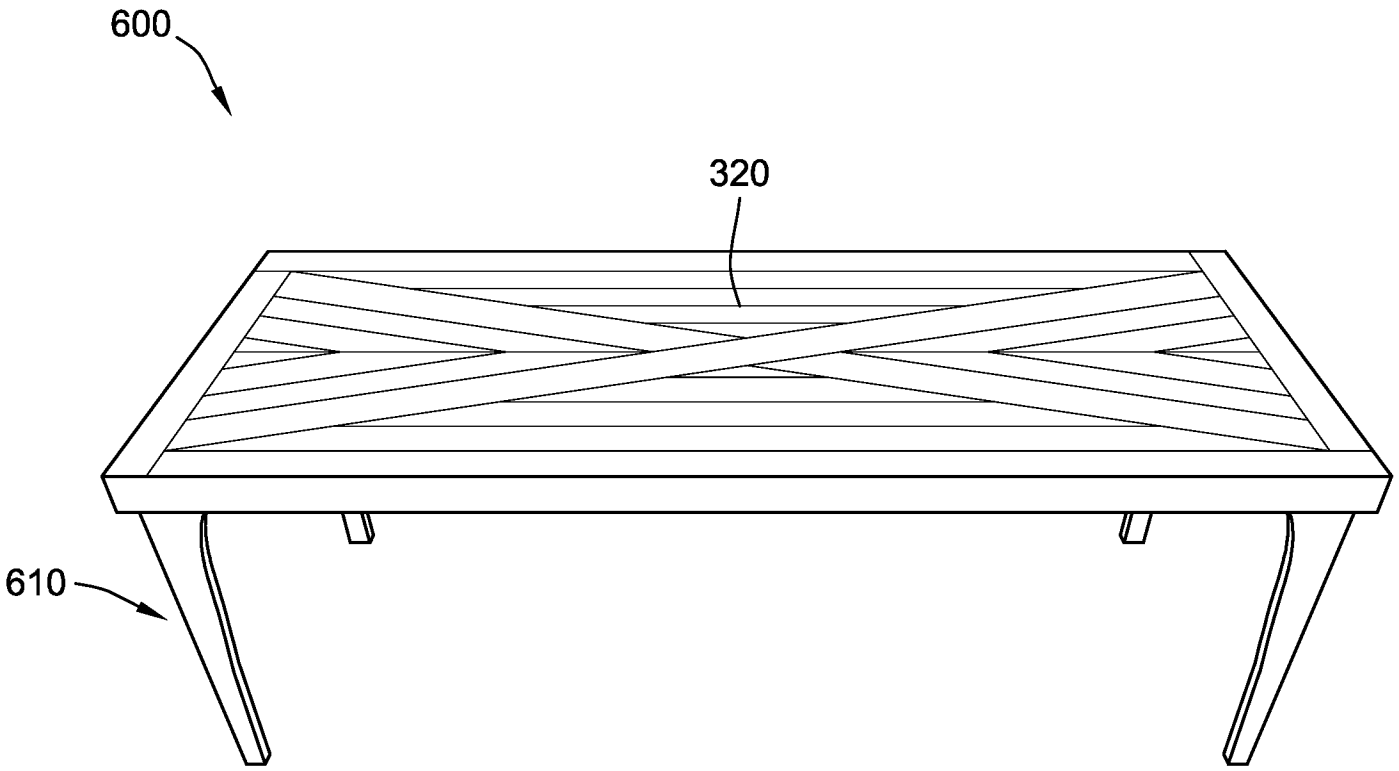
FIG. 6A is a perspective view of a coffee table formed with the table top, according to certain aspects of the present invention.

FIG. 6A shows a perspective view of a coffee table 600. In the embodiment shown in FIG. 6A, the coffee table 600 includes a table top 320 and four detachable legs 610. In different embodiments, the coffee table 600 may include three or more detachable legs 610. The detachable legs 610 are placed into the table top 320 and provide support for the coffee table 600. The detachable legs 610 can vary in shape and size. In the embodiment shown in FIG. 6A, the detachable legs 610 have a generally rectangular cross-section, but the detachable legs 610 can also have a square or circular cross-section. The detachable legs 610 can be made from a sturdy and durable material such as, but not limited to, wood, stainless steel, plastic. The coffee table 600 offers a shorter height of table compared to the dining table 500 shown in FIG. 5A-5B.

Figure 6B:
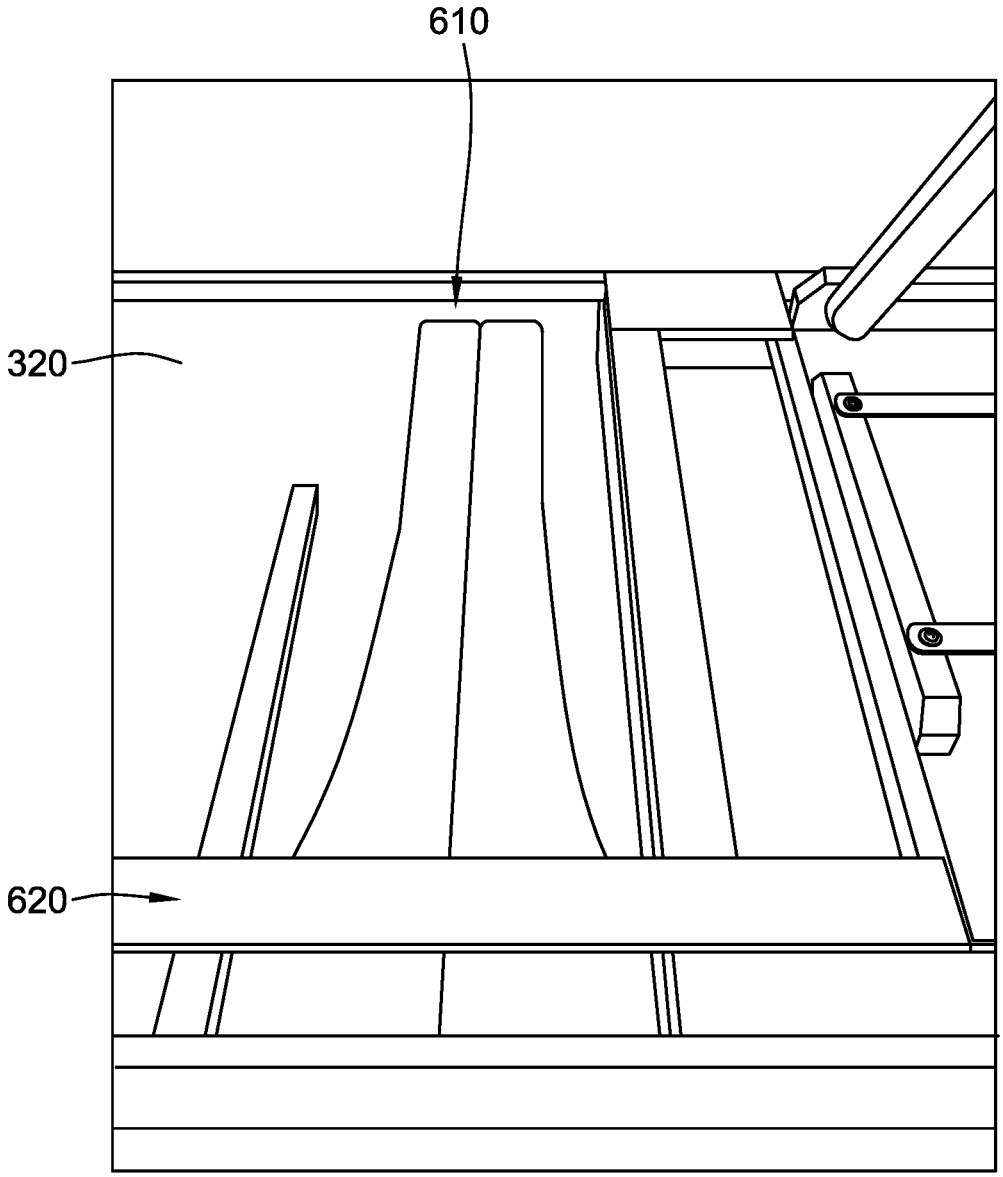
FIG. 6B is a perspective view showing how coffee table legs stored within the table top in the space-saving furniture assembly, according to certain aspects of the present invention.

FIG. 6B shows a perspective view of how the detachable legs 610 are stored within the table top 320. The detachable legs 610 are stored in a retaining element 620 within the table top 320, as shown. This allows for the detachable legs 610 to be included in the space-saving furniture assembly 300 (not shown). Since the detachable legs 610 are stored within the retaining element 620 of the table top 320, the detachable legs 610 provide the benefit of not requiring a separate storage space.

Advantageously, the space-saving furniture assembly allows for the use and storage of various furniture components without sacrificing limited floor space. The components of the space-saving furniture assembly can be arranged to create a folding table, a side table, a dining table, and a coffee table. While producing all the listed various uses, every component can be stored within the housing unit.

Although the disclosed embodiments have been illustrated and described with respect to one or more implementations, equivalent alterations and modifications will occur or be known to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

While various embodiments of the present disclosure have been described above, it should be understood that they have been presented by way of example only, and not limitation. Numerous changes to the disclosed embodiments can be made in accordance with the disclosure herein, without departing from the spirit or scope of the disclosure. Thus, the breadth and scope of the present disclosure should not be limited by any of the above described embodiments. Rather, the scope of the disclosure should be defined in accordance with the following claims and their equivalents.

What is claimed is:

1. A furniture assembly comprising:

a housing unit;

a reversible serving tray having four handles, the reversible serving tray being stored within the housing unit;

a table top stored within the housing unit;

three or more detachable legs configured to connect with the table top to form a coffee table; and one or more folding tables stored within the housing unit, each folding table comprising:

a base comprising:

two support beams disposed along a first pair of opposite ends of a perimeter of a bottom surface of the base; and one or more support bars coupled between the two support beams; and an x-shaped leg assembly coupled to the base, the x-shaped leg assembly comprising:

a first rectangular frame having a first leg and a second leg connected by a first cross beam proximal to the bottom surface of the base, the first cross beam having one or more channels for accommodating each of the one or more support bars; and a second rectangular frame mechanically coupled to the first rectangular frame and the base, wherein the first cross beam moves along the one or more support bars between the two support beams to fold and unfold the folding table.

2. The furniture assembly of claim 1, wherein the base further comprises a first side beam and a second side beam disposed along a second pair of opposite ends of the perimeter of the bottom surface of the base.

3. The furniture assembly of claim 2, wherein the second rectangular frame includes a third leg coupled to the first side beam and a fourth leg coupled to the second side beam.

4. The furniture assembly of claim 1, wherein the first rectangular frame and the second rectangular frame are coupled at a center along a length of each of the first rectangular frame and the second rectangular frame.

5. The furniture assembly of claim 2, wherein:

the first side beam and the second side beam are parallel to each other; and the two support beams are each perpendicular to the first side beam and the second side beam.

6. The furniture assembly of claim 2, wherein each of the one or more support bars extend parallel to the first side beam and the second side beam.

7. The furniture assembly of claim 1, wherein the housing unit is configured to be mounted on a wall.

8. The furniture assembly of claim 1, wherein the reversible serving tray is configured to be disposed over one of the folding tables to form a side table.

9. A furniture assembly comprising:

a housing unit;

a table top stored within the housing unit; and one or more folding tables stored within the housing unit, each folding table comprising:

a base comprising:

two support beams disposed along a first pair of opposite ends of a perimeter of a bottom surface of the base, one or more support bars coupled between the two support beams, and a first side beam and a second side beam disposed along a second pair of opposite ends of the perimeter of the bottom surface of the base, wherein (i) the first side beam and the second side beam are parallel to each other and (ii) the two support beams are each perpendicular to the first side beam and the second side beam; and an x-shaped leg assembly coupled to the base, the x-shaped leg assembly comprising:

a first rectangular frame having a first leg and a second leg connected by a first cross beam proximal to the bottom surface of the base, the first cross beam having one or more channels for accommodating each of the one or more support bars, wherein the first cross beam moves along the one or more support bars between the two support beams to fold and unfold the folding table, and a second rectangular frame mechanically coupled to the first rectangular frame and the base;

wherein the table top is configured to be secured on top of two of the folding tables with the X-shaped leg assembly positioned along either a length or a breadth of the table top, to form a dining table.

10. The furniture assembly of claim 9, wherein the second rectangular frame includes a third leg coupled to the first side beam and a fourth leg coupled to the second side beam.

11. The furniture assembly of claim 9, wherein each of the one or more support bars extend parallel to the first side beam and the second side beam.

12. The furniture assembly of claim 9, wherein the first rectangular frame and the second rectangular frame are coupled at a center along a length of each of the first rectangular frame and the second rectangular frame.

13. The furniture assembly of claim 9, wherein the housing unit is configured to be mounted on a wall.

14. The furniture assembly of claim 9, wherein the housing unit contains a reversible serving tray having four handles.

15. The furniture assembly of claim 14, wherein the housing unit stores the reversible serving tray, the one or more folding tables, and the table top.

16. The furniture assembly of claim 14, wherein the reversible serving tray is configured to be disposed over one of the folding tables to form a side table.

* * * * *